US007793881B1

(12) United States Patent
Torres

(10) Patent No.: US 7,793,881 B1
(45) Date of Patent: Sep. 14, 2010

(54) PORTABLE MULTIPLE HOSE ROLLER

(76) Inventor: Jose Hipolito Torres, 541 McBride La., Corpus Christi, TX (US) 78408

( * ) Notice: Subject to any disclaimer, the term of this patent is extended or adjusted under 35 U.S.C. 154(b) by 85 days.

(21) Appl. No.: 12/348,007

(22) Filed: Jan. 1, 2009

Related U.S. Application Data

(60) Provisional application No. 61/018,577, filed on Jan. 2, 2008.

(51) Int. Cl.
*B65H 19/28* (2006.01)

(52) U.S. Cl. ..... 242/532.6; 242/587.2; 242/533.8; 242/403; 242/557

(58) Field of Classification Search ... 242/532.5–532.6, 242/533.8, 403, 557, 586.2, 587.2
See application file for complete search history.

(56) References Cited

U.S. PATENT DOCUMENTS

| | | | | |
|---|---|---|---|---|
| 2,960,279 | A | 11/1960 | Little | |
| 3,168,260 | A | 2/1965 | Kittelson | |
| 3,319,905 | A | 5/1967 | Kissilov | |
| 3,627,224 | A | 12/1971 | Diggs | |
| 3,866,532 | A | 2/1975 | Ogden, Jr. | |
| 3,946,964 | A | 3/1976 | Zinser | |
| 4,057,198 | A * | 11/1977 | Whitfield | 242/532.6 |
| 4,161,298 | A * | 7/1979 | Davis | 242/530.3 |
| 4,265,414 | A | 5/1981 | Spradling | |
| 4,366,933 | A | 1/1983 | Broussard | |
| 4,452,135 | A | 6/1984 | Hayes | |
| 4,592,519 | A | 6/1986 | Peacock | |
| 4,732,345 | A | 3/1988 | Golden | |
| 5,033,690 | A | 7/1991 | McIver | |
| 5,211,351 | A | 5/1993 | DeClerck | |
| 5,505,404 | A | 4/1996 | Dubreuil | |
| 5,533,689 | A * | 7/1996 | Chalfant | 242/532.5 |
| 5,566,901 | A | 10/1996 | Wilder | |
| 5,988,559 | A | 11/1999 | Gnass | |
| 6,135,139 | A | 10/2000 | Blake, Jr. | |
| 6,206,317 | B1 | 3/2001 | Harvestine | |
| 6,241,175 | B1 | 6/2001 | Nichols | |
| 6,811,110 | B2 * | 11/2004 | Tsao | 242/530.2 |
| 6,926,027 | B1 | 8/2005 | Sorensen | |
| 2003/0192979 | A1 | 10/2003 | Olson | |
| 2005/0011979 | A1 | 1/2005 | Best et al. | |

* cited by examiner

*Primary Examiner*—Sang Kim
(74) *Attorney, Agent, or Firm*—George S. Gray

(57) ABSTRACT

A multiple hose rolling device is provided that is readily attachable to a vehicle and rolls multiple hoses of different flattened widths simultaneously. The device includes guides that adjust to accommodate the widths of the hoses, a closed dual-spindle system to prevent inadvertent displacement of the coiled hose from the spindle, a mechanism for assuring the pre-drainage liquid and air from hose portions about to enter the coil, and a mechanism for preventing the final end hose coupling from inadvertently being coiled. The device may be positioned to the side of the vehicle with the spindles extending outwardly from the vehicle and includes an electric motor for rotating the primary spindle, which can be powered by its own battery or the vehicle's battery. Precisely positionable guides are provided for carefully separating and guiding several hoses of different flattened widths as they approach the spindles.

7 Claims, 14 Drawing Sheets

PORTABLE MULTIPLE HOSE ROLLER

CROSS-REFERENCE TO PRIOR APPLICATION

This application claims priority from U.S. Provisional Patent Application Ser. No. 61/018,577, filed Jan. 2, 2008, the inventor being Jose Hipolito Torres. Such application is incorporated herein by reference for all purposes.

BACKGROUND OF THE INVENTION

1. Field of the Invention

The field of the invention is fire fighting equipment, or, more specifically equipment for simultaneously and safely rolling multiple flattenable fire hoses, of different sizes, into coils.

2. Description of Related Art

Fire fighting personnel are constantly challenged by the awkward and strenuous task of rolling several fire hoses, of different sizes (i.e. different flattened widths), back into storable coils, while on the scene of a fire event in which several such hoses were unrolled for use. The hoses are of significant weight, and are made heavier in many cases by the presence of water remaining in the hoses. Manually lifting, folding, draining, or coiling the hoses requires significant personnel exertion, often by personnel already exhausted by activities during the fire itself. Existing hose rollers are often required to be permanently attached to a vehicle, have complex mechanisms, roll only one hose at a time, have open-ended tines or spindles, are sized for only one size hose, provide no mechanism for guiding hoses of different flattened widths on to spindles or tines, provide no mechanism for assuring drainage of the hose in the hose portion entering the coil, or provide no mechanism to prevent the final end hose coupling from being rolled inadvertently on to the coil and inducing slack and the unwanted hazard of a coupling rotating repeatedly about the coil axis.

Different devices have been provided by those in the field for rolling a flattenable hose into a coil. U.S. Pat. No. 5,033,690 (McIver) discloses a hose roller for a single hose that is attachable to a truck. A guide assembly (26A, 26B, 26C on McIver, FIG. 1) can be adjusted for a single hose of different width, but not for simultaneously rolling multiple hoses. U.S. Pat. No. 4,265,414 (Spradling) discloses a hand-cranked hose roller, apparently for a single hose, that is attachable to a truck. The device has open-ended tines, a wide initial spool without adjustable guides to accommodate hoses of different flattened widths, and no mechanism to prevent the hose coupling from being coiled inadvertently. U.S. Pat. No. 2,960,279 (Little) discloses a hose roller, attachable to a vehicle, for a single hose width limited by the initial stud (96,97 on Little, FIG. 2), which cannot be adjusted for hoses of different flattened widths. The hose must be doubled at its center point prior to use of the device, and the device has an open-ended hub. U.S. Pat. No. 6,241,175 (Nichols) discloses a hose roller for a single hose, with open-ended pegs, with no hose guide, no mechanism for assuring the hose is drained before entering the coil, and no mechanism for preventing the final end hose coupling from being coiled inadvertently. U.S. Pat. No. 4,592,519 (Peacock) discloses a hose roller, attachable to a vehicle, with open-ended rolling fork, for a single hose, with no mechanism for adjusting the hose guide to the width of the hose, and with no mechanism provided for preventing the final end hose coupling from being coiled inadvertently.

What is needed is a device that is readily attachable to a vehicle, rolls multiple hoses of different flattened widths simultaneously, with guides that adjust to accommodate the widths of the hoses, a closed spindle system to prevent inadvertent displacement of the coiled hose from the spindle, a mechanism for assuring the pre-drainage of hose portions about to enter the coil, and a mechanism for preventing the final end hose coupling from inadvertently being coiled.

SUMMARY OF THE INVENTION

My invention provides a multiple hose rolling device that is readily attachable to a vehicle, rolls multiple hoses of different flattened widths simultaneously, with guides that adjust to accommodate the widths of the hoses, a closed dual-spindle system to prevent inadvertent displacement of the coiled hose from the spindle, a mechanism for assuring the pre-drainage liquid and air from hose portions about to enter the coil, and a mechanism for preventing the final end hose coupling from inadvertently being coiled.

My invention also includes the positioning of the device to the side of the vehicle with the spindles extending outwardly from the vehicle, and an electric motor for rotating the primary spindle, which can be powered by its own battery or the vehicle's battery. Precisely positionable guides are provided for carefully separating and guiding several hoses of different flattened widths as they approach the spindles.

My invention can also be quickly assembled and disassembled on location with the components being readily stored in the bed of the light duty truck to which it is attachable during use.

In some exemplary embodiments I have provided an apparatus for rolling a flattenable hose of the type having a first coupling at a hose first end and a second coupling at a hose second end, and a hose portion between the hose first coupling and the hose second coupling, the hose being in the proximity of a vehicle, comprising: a frame, attachable to the vehicle, the frame having a hinge; a rotation member, the rotation member being alternately startable and stoppable; a roller on the frame; a first spindle on the frame, laterally spaced from the roller, the first spindle having a first end and a second end, the first spindle first end cooperating with the rotation member, such that the first spindle is rotated by the rotation member, the first spindle second end being engaged by the frame for support during rotation; a second spindle, attachable to the first spindle; a plurality of guide poles on the frame; and a gate member on the frame, the gate being positionable to a position proximate the roller; wherein: the hose first end is placed over the roller, under the gate, and between two of the plurality of guide poles, and the hose drains any liquid contents as the hose first end is elevated over the roller; the hose first coupling and hose first end are secured to the first spindle by attaching the second spindle to the first spindle; the first spindle is rotated by starting the rotation member, the hose being rolled about the first and second spindle into a hose coil as the first spindle is rotated, the hose being flattened as the hose is drawn over the roller, the hose being guided by the guide poles, the hose second coupling encountering the gate member as it approaches the roller, the hose second coupling being prevented by the closed gate member from being moved over the roller; and after the rotation member is stopped, the frame is moved on the frame hinge such that the first spindle second end is clear of the frame, the second spindle being detachable from the first spindle and removable from the hose coil, the hose second coupling being removable from the gate member, and the hose coil being removable from the first spindle.

In some exemplary embodiments, the gate member is movable from a first position, allowing insertion of the hose first end and hose first coupling to a second position, laterally spaced from the roller, whereby the hose second coupling is prevented from passing the gate member.

In some exemplary embodiments, the number of guide poles is at least three such that two hoses are positionable between two guide poles and separated by the guide poles.

In some exemplary embodiments, the rotation member is an electric motor.

In some exemplary embodiments I have provided an apparatus for rolling a flattenable hose of the type having a first coupling at a hose first end and a second coupling at a hose second end, and a hose portion between the hose first coupling and the hose second coupling, the hose being in the proximity of a vehicle, comprising: frame means, attachable to the vehicle, the frame means having a hinge; rotation means, the rotation means being alternately startable and stoppable; roller means on the frame means; first spindle means on the frame means, laterally spaced from the roller means, the first spindle means having a first end and a second end, the first spindle means first end cooperating with the rotation means, such that the first spindle means is rotated by the rotation means, the first spindle means second end being engaged by the frame means for support during rotation; second spindle means, attachable to the first spindle means; guide means, the guide means having a plurality of guide poles on the frame means; and gate means on the frame means, the gate means being positionable to a position proximate the roller means; wherein: the hose first end is placed over the roller means, under the gate means, and between two of the plurality of guide poles, and the hose drains any liquid contents as the hose first end is elevated over the roller means; the hose first coupling and hose first end are secured to the first spindle means by attaching the second spindle means to the first spindle means; the first spindle means is rotated by starting the rotation means, the hose being rolled about the first and second spindle means into a hose coil as the first spindle means is rotated, the hose being flattened as the hose is drawn over the roller means, the hose being guided by the guide poles, the hose second coupling encountering the gate means as it approaches the roller means, the hose second coupling being prevented by the closed gate means from being moved over the roller means; and after the rotation means is stopped, the frame means is moved on the frame means hinge such that the first spindle means second end is clear of the frame means, the second spindle means being detachable from the first spindle means and removable from the hose coil, the hose second coupling being removable from the gate means, and the hose coil being removable from the first spindle means.

In some exemplary embodiments, the gate means is movable from a first position, allowing insertion of the hose first end and hose first coupling to a second position, laterally spaced from the roller means, whereby the hose second coupling is prevented from passing the gate means.

In some exemplary embodiments, the number of guide poles is at least three such that two hoses are positionable between two guide poles and separated by the guide poles.

In some exemplary embodiments, the rotation means is an electric motor.

In some exemplary embodiments I have provided a method for rolling a flattenable hose of the type having a first coupling at a hose first end and a second coupling at a hose second end, and a hose portion between the hose first coupling and the hose second coupling, the hose being in the proximity of a vehicle, comprising: attaching a frame to the vehicle, the frame having a hinge and a rotation member, the rotation member being alternately startable and stoppable; placing a roller on the frame; placing a first spindle on the frame, the first spindle having a first end and a second end, the first spindle first end cooperating with the rotation member, such that the first spindle is rotated by the rotation member, the first spindle second end being engaged by the frame for support during rotation; placing a plurality of guide poles on the frame; attaching a gate to the frame, the gate being swingable to a position proximate the roller; placing the hose first end over the roller, under the gate, and between two of the plurality of guide poles, the hose draining any liquid contents as the hose first end is elevated over the roller, the hose being flattened against the roller as the roller rotates; securing the hose first coupling and hose first end by attaching a second spindle to the first spindle; rotating the first spindle by starting the rotation member, the hose being rolled about the first and second spindle into a hose coil as the first spindle is rotated, the hose being flattened as the hose is drawn over the roller, the hose being guided by the guide poles, the hose second coupling encountering the gate as it approaches the roller, the continued movement of the hose second coupling causing the gate to move to close against the frame, the hose second coupling being prevented by the closed gate from being moved over the roller; stopping the rotation of the first spindle by stopping the rotation member; opening the gate and releasing the hose second coupling; moving the frame on the frame hinge, such that the first spindle second end is clear of the frame; removing the second spindle from attachment to the first spindle and pulling the second spindle from the hose coil; pulling the hose coil from the first spindle; removing the roller, gate, first spindle, and guide poles from the frame; and removing the frame from the vehicle.

In some exemplary embodiments, a second hose has a hose first end, a hose first coupling, a hose second end, a hose second coupling, and a hose portion between the hose first coupling and the hose second coupling, the method further comprising: the step of placing the second hose first end over the roller, under the gate, and between two of the plurality of guide poles, at least one of the two of the plurality being in addition to the two of the plurality of guide poles guiding the first hose, the second hose draining any liquid contents as the second hose first end is elevated over the roller; and further wherein: the step of securing the hose first coupling and hose first end, further comprises securing the second hose first coupling and second hose first end, both securements being accomplished by attaching the second spindle to the first spindle; the step of rotating the first spindle by starting the rotation member further results in the second hose being rolled about the first and second spindle into a second hose coil as the first spindle is rotated, the second hose being flattened as the second hose is drawn over the roller, the second hose being guided by the guide poles; the step of removing the second spindle from attachment to the first spindle and pulling the second spindle from the hose coil further comprises pulling the second spindle from the second hose coil; the step of pulling the hose coil from the first spindle, further comprises pulling the second hose coil from the first spindle.

In some exemplary embodiments, the frame positions the first spindle in a substantially perpendicular orientation to the vehicle's longitudinal axis, and the method further comprises the step of moving the vehicle in a substantially parallel path to the hose, as the hose is being rolled.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

The following discussion describes exemplary embodiments of the invention in detail. This discussion should not be construed, however, as limiting the invention to those particular embodiments. Practitioners skilled in the art will recognize numerous other embodiments as well.

Figure 1:
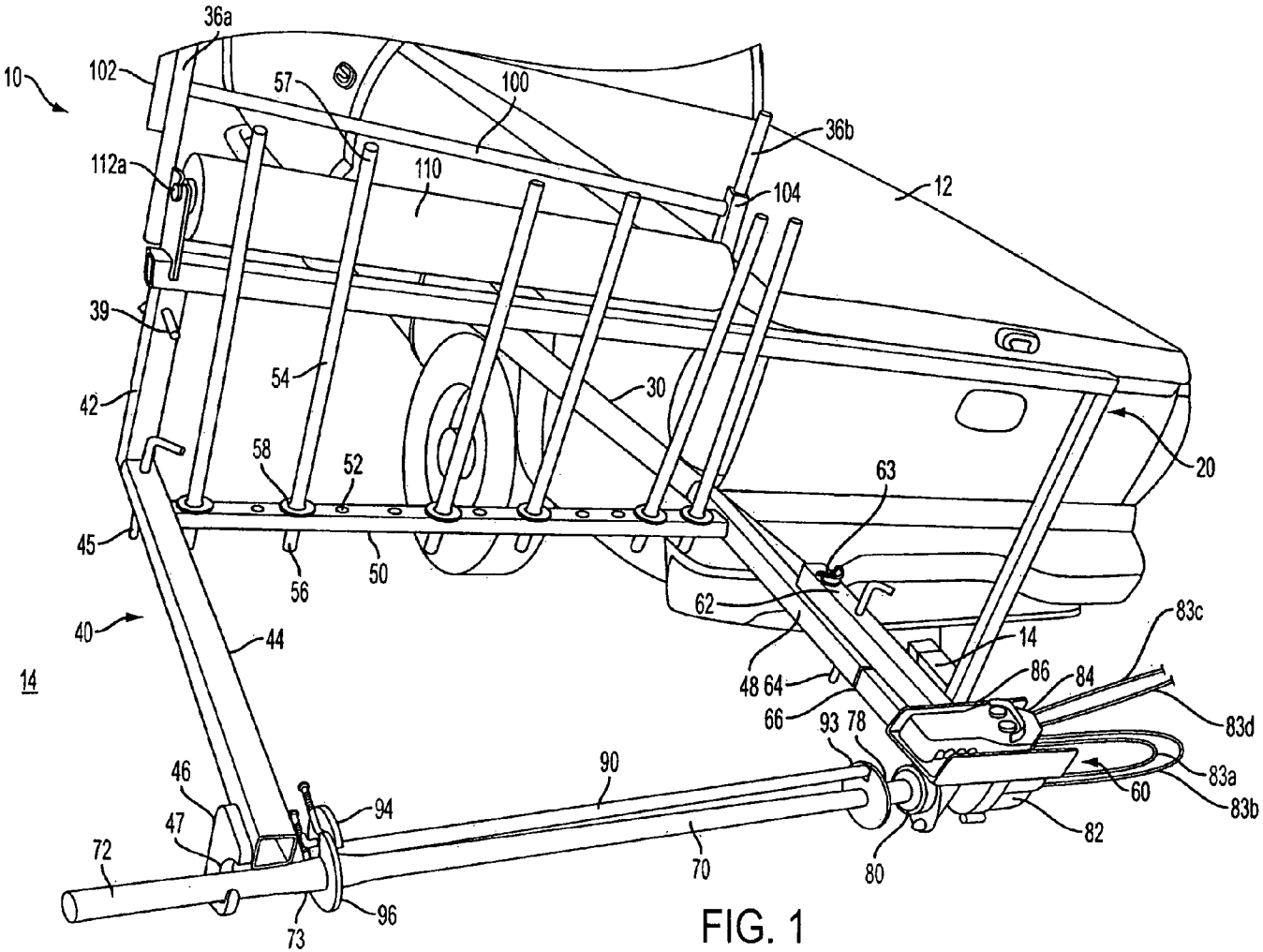
FIG. 1 is a rear perspective view of an exemplary embodiment of the multiple hose roller of the present invention attached to a conventional rear hitch on a light duty truck.
Figure 2:
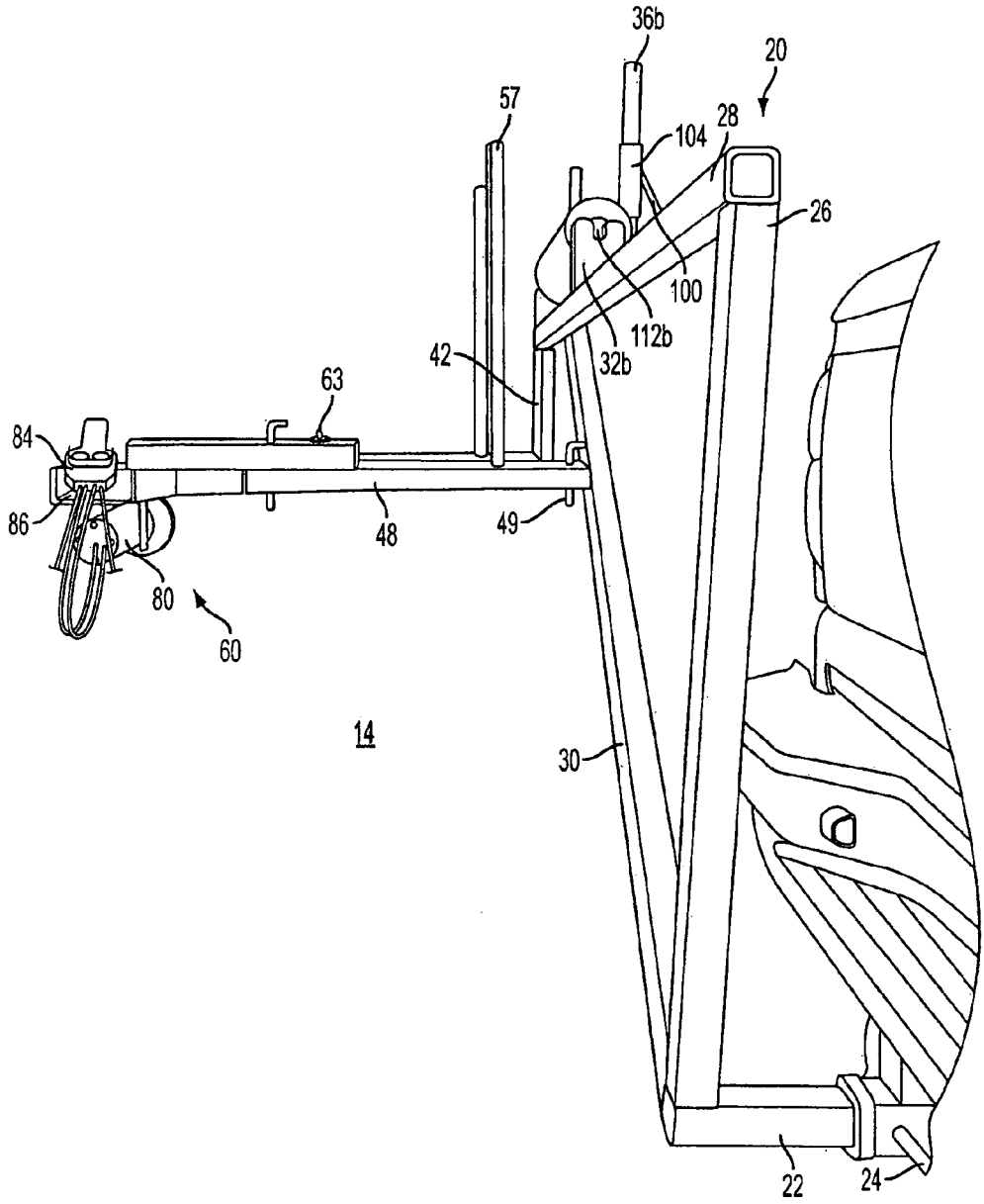
FIG. 2 is a side view of an exemplary embodiment of the multiple hose roller of the present invention attached to a conventional rear hitch on a light duty truck.
Figure 3:
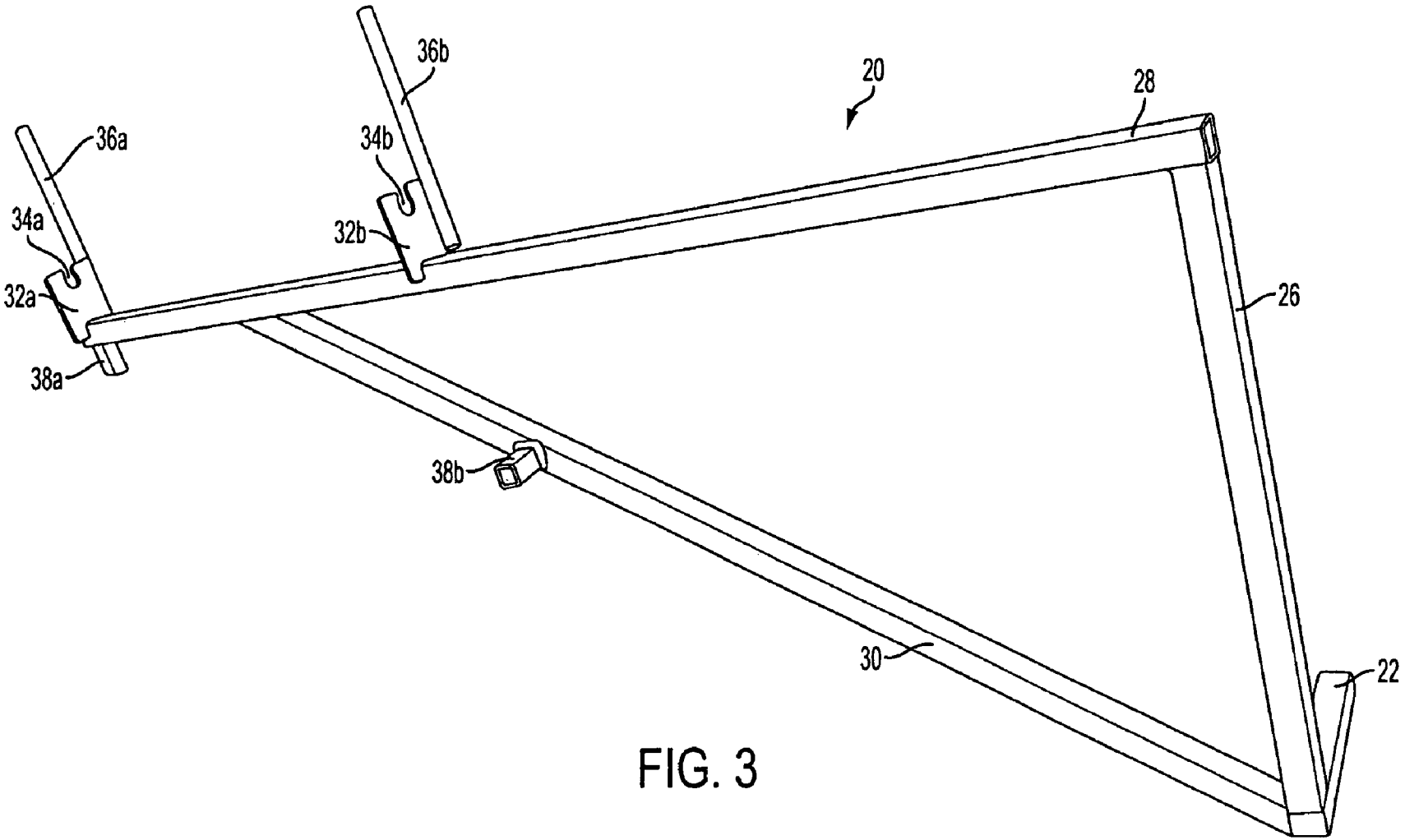
FIG. 3 is a perspective view of the frame component of an exemplary embodiment of the present invention.

Turning now to FIGS. 1-3, wherein an exemplary embodiment of the present invention is illustrated with the hose roller 10 shown in perspective, attached to a vehicle 12, using the vehicle's conventional trailer coupling receiver 14, the hose roller 10 having a frame 20 with a coupling member 22 sized for mating with the coupling receiver, the coupling member 22 being pinned within the receiver in the conventional manner, using pin 24. In some exemplary embodiments the frame 20 extends in a substantially perpendicular direction from the longitudinal axis of the vehicle 12, the frame 20 having a riser 26 and a substantially horizontal member 28 supported by a brace 30. In some exemplary embodiments of the type depicted in FIGS. 1-3 a pair of roller supports 32*a,b* extend upwardly from the frame horizontal member 28, each having grooves 34*a,b*, (for use as described below), a pair of vertical gate members 36*a,b* extend upwardly from the frame horizontal member 28, and a pair of sub-frame connection members 38*a,b* (for use as described below, the first sub-frame connection member 38*a* extending downwardly from the frame horizontal member 28, the second sub-frame connection member 38*b* extending rearwardly from the frame brace 30.

In some exemplary embodiments of the type illustrated in FIGS. 1-3 a generally "H" shaped sub-frame 40 extends rearwardly from the frame 20 in an orientation substantially horizontal to the ground surface 14. In such exemplary embodiments, a sub-frame riser 42 is pinned to the first sub-frame connection member 38*a* using pin 39, the sub-frame riser extending downwardly then turning rearwardly for pinning to a sub-frame first side member 44 using pin 45, the sub-frame first side member then extending rearwardly and having a spindle support member 46 having a rounded notch 47 (for use as described below). The sub-frame 40 has a second side member 48 pinned to the second sub-frame connection member 38*b* using pin 49, and a sub-frame cross member 50 extending between the sub-frame first and second side members 44,48, the cross member having a number of holes 52 in the cross member top and bottom for receiving hose guide poles 54, each hose guide pole having a first end 56 for insertion into the cross member holes, a second end 57, and a stop 58 for positioning the guide pole second end at the desired distance above the cross member.

Figure 5:
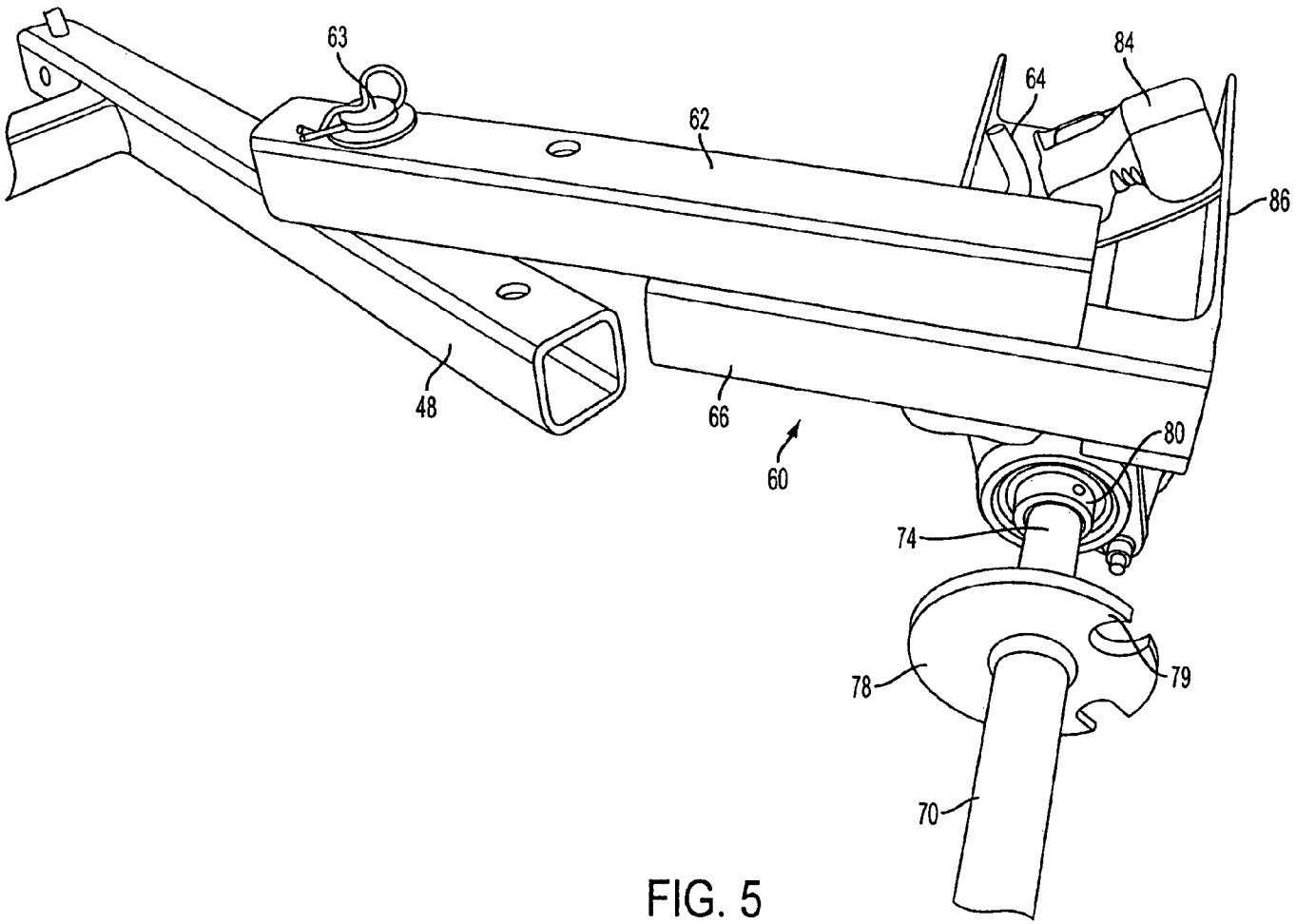
FIG. 5 is a side view of a spindle rotation assembly of an exemplary embodiment of the present invention.

Turning now to FIG. 5, wherein an exemplary embodiment of the present invention is shown to have a spindle rotation assembly 60 having a hinge member 62 attached to the sub-frame second side 48 using hinge pin 63, the hinge member being rotatable about the hinge pin 63 and lockable for alignment with the sub-frame second side member 48 using pin 64. Attached to the hinge member 62 is an extension member 66 which, when the hinge member 62 is locked, aligns with sub-frame second side member 48 and effectively extends the second side member 48 to a point substantially coinciding with the rearward end of the sub-frame first side member 44.

Figure 4:
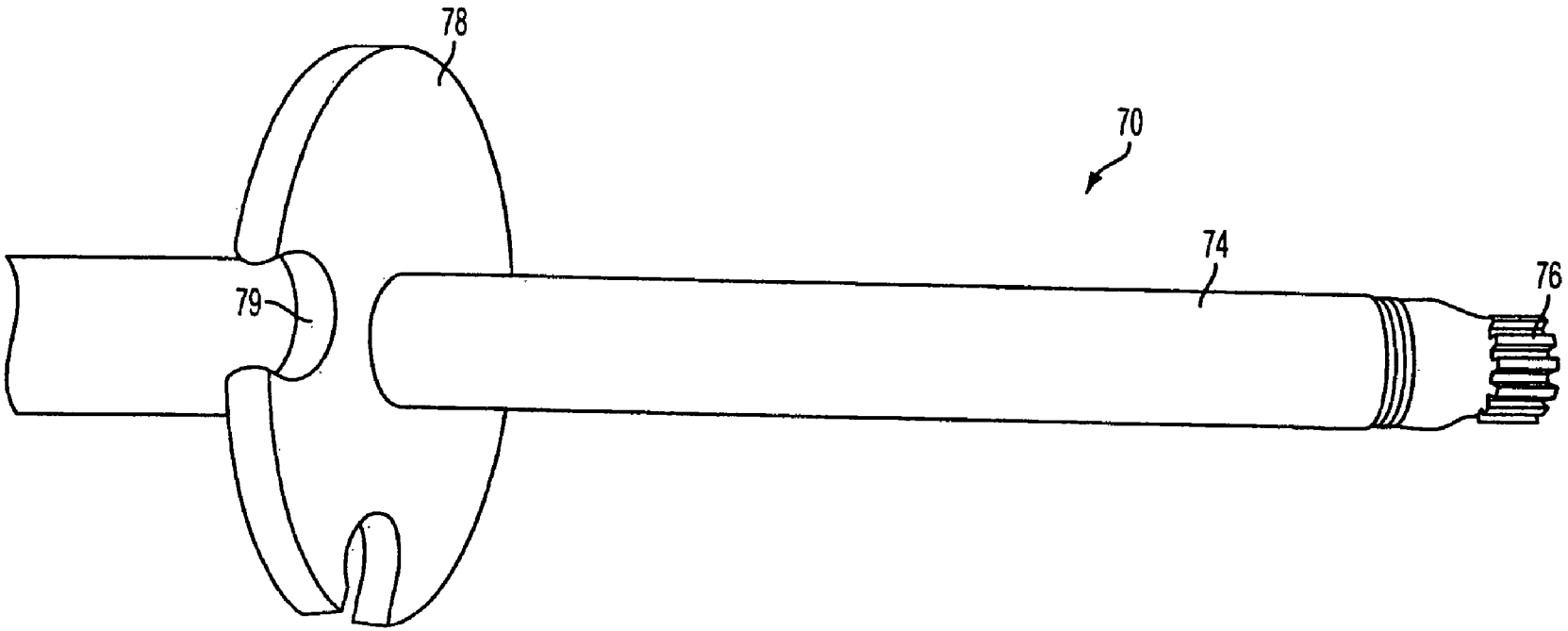
FIG. 4 is a top view of a portion of the primary/first spindle component of an exemplary embodiment of the present invention.
Figure 6:
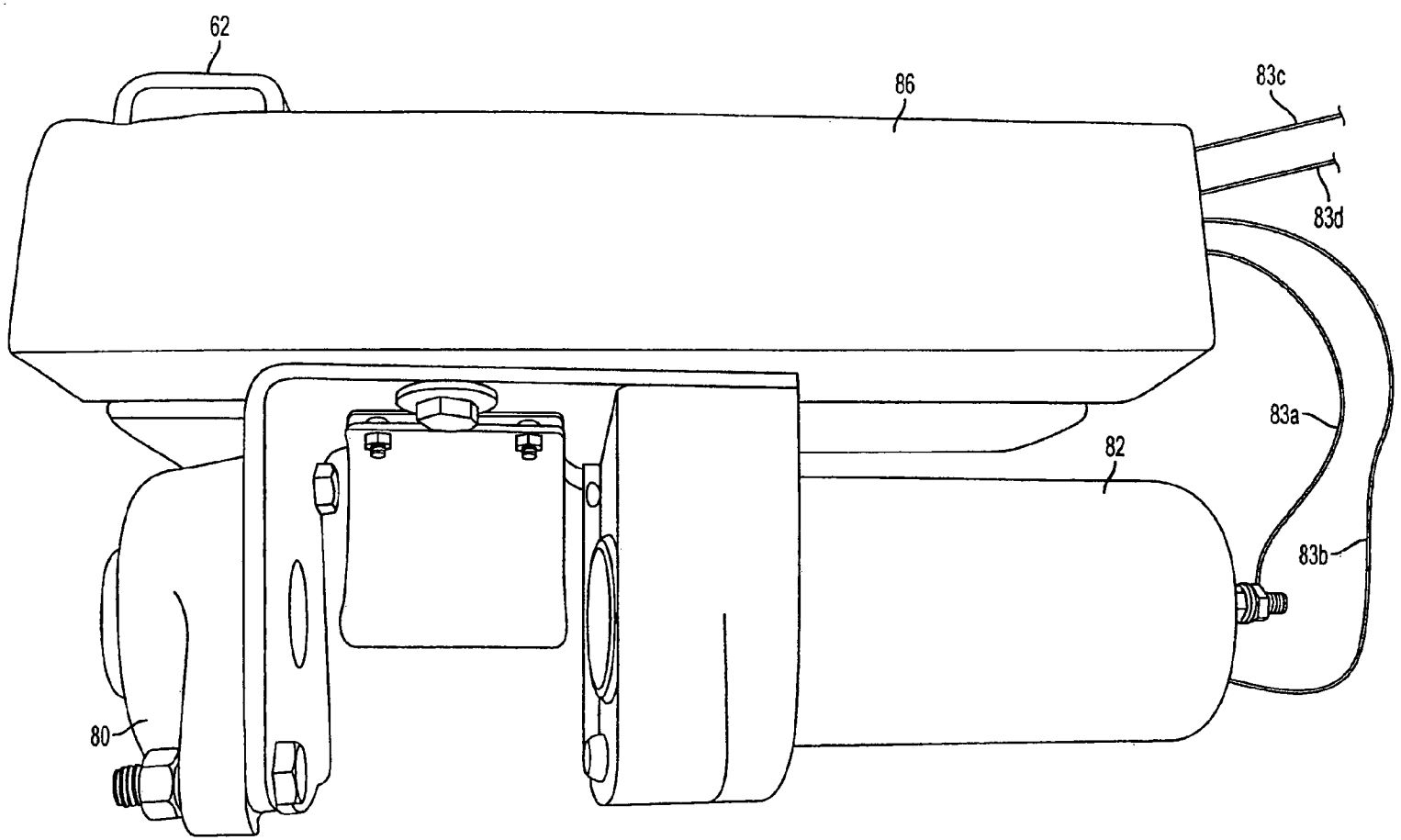
FIG. 6 is a rear view of a rotation member/electric motor drive assembly of an exemplary embodiment of the present invention.

As further illustrated for some exemplary embodiments in FIG. 1 and FIG. 4, a first spindle 70 has a first end body portion 72 that is placeable and rotatable in the sub-frame first side member spindle support member 46 using the rounded notch 47. In such exemplary embodiments, the first spindle 70 has a second end 74, with gear teeth 76, and a second spindle support member 78 having a rounded notch 79 (for use as described below). As shown further for such exemplary embodiments in FIG. 5, the first spindle second end 74 is placed through a spindle guide 80 that is attached to the spindle rotation assembly 60, the first spindle second end 74 extending through the spindle guide 80 and into an electric motor 82 (attached to the spindle rotation assembly) wherein the first spindle second end gear teeth 76 mesh with the electric motor such that the first spindle 70 is rotated when the motor is turned on. As further illustrated for such exemplary embodiments in FIGS. 5-6, a conventional controller 84, storable in a tray 86, for operating the electric motor, is conventionally wired to the motor, and leads 88*a,b* are used for conventional attachment of the electric motor to a power source such as a battery (not shown). In some exemplary embodiments, the battery is the vehicle battery and conventional vehicle wiring is utilized in cooperation with the leads 88*a,b*.

Figure 7:
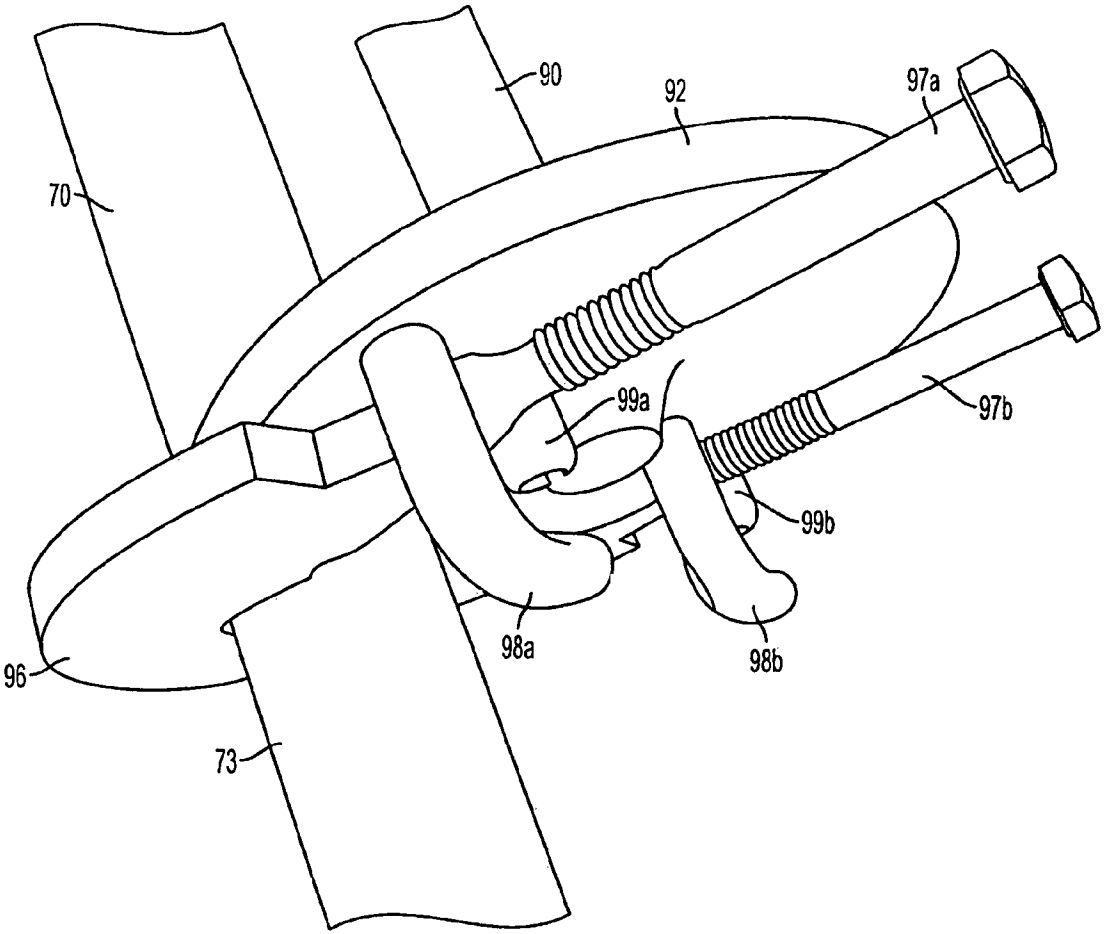
FIG. 7 is a perspective view of lock plate and lock plate clamp components securing the second spindle to the first spindle in an exemplary embodiment of the present invention.

For exemplary embodiments of the present invention of the type illustrated in FIG. 1, and as further illustrated in FIG. 7, a second spindle 90 has a first end lock plate 92 and a second end 93 that is placeable and rotatable within the second spindle support member 78 using the rounded notch 79. A lock plate clamp 96 is first placed about a flattened area 73 on the first spindle 70 and has two protruding members 97*a,b* that are each insertable through a gap formed between lock plate hooks 98*a,b* and a corresponding lock plate extensions 99*a,b*, the protruding members 97*a,b* thereby being clamped to the second spindle first end lock plate 92. When so attached and positioned the second spindle 90 is held in a substantially parallel position with respect to the first spindle 70, and rotates with the first spindle when the motor 82 is on.

Figure 13:
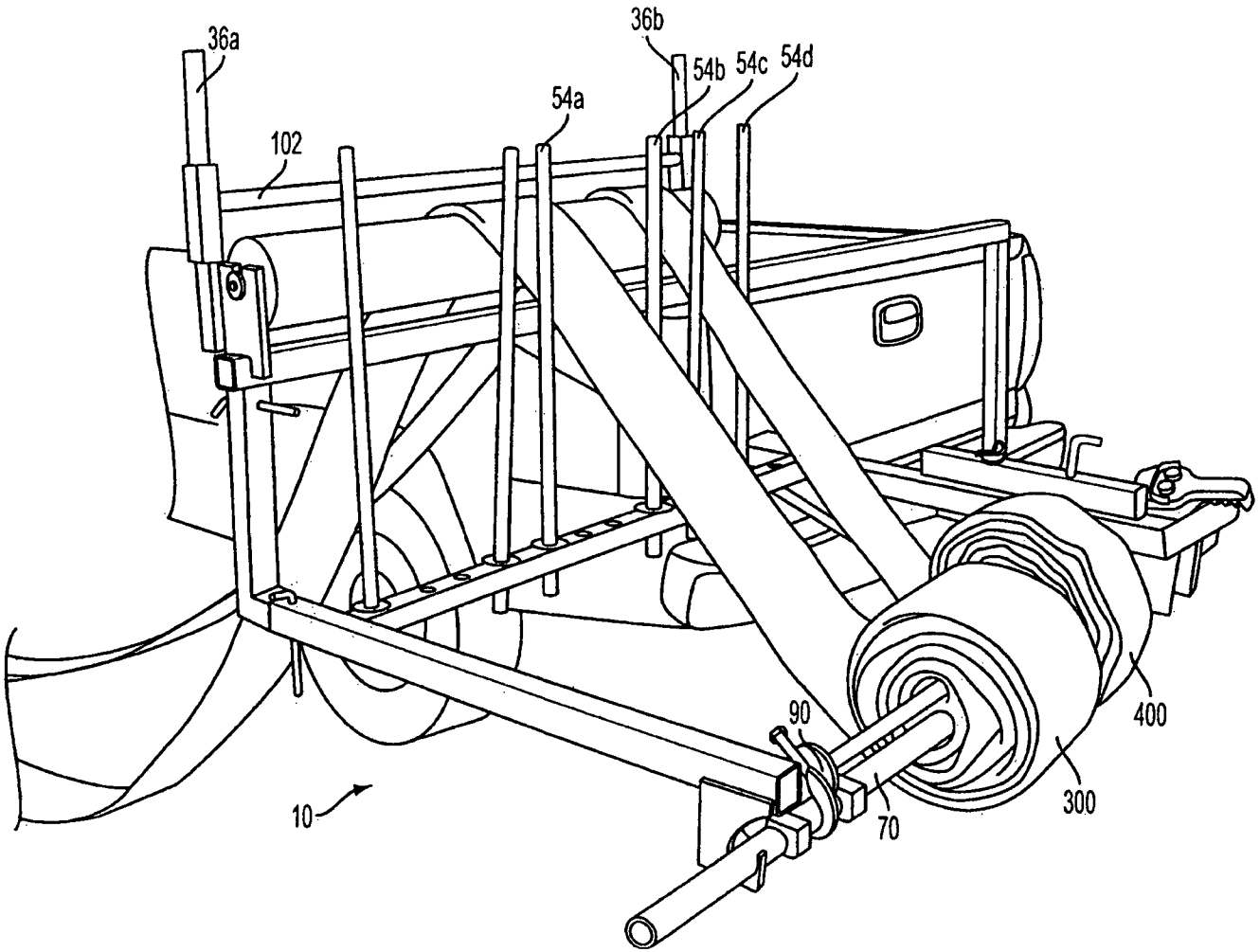
FIG. 13 is a perspective view of an exemplary embodiment of the present invention while two hoses of different flattened widths are being rolled, with each hose being guided by a pair of adjustable guides.

Turning again to FIGS. 1-2, wherein the vertical gate members 36*a,b* are further shown in association with a gate 100 having a first end 102 and a second end 104, each end being sized and oriented to receive the vertical gate members 36*a,b* (circular in cross-section) and position the gate 100 substantially across the span between the vertical gate members. In exemplary embodiments of the type depicted in FIGS. 1-2, the second end 104 is received by vertical gate member 36*b*, about which the gate 100 is pivotable, the gate being closable to a position such that the gate is generally parallel with a roller 110, the roller having roller spindles 112*a,b* at its ends, the roller spindles being placeable and rotatable within the roller supports 32*a,b* using roller support rounded grooves 34*a,b*. Optionally, the gate 100 can be secured in a closed position by additionally placing gate first end 102 on to the adjacent vertical gate member 36*a*, as shown in FIG. 13.

In a typical use of the present invention, the operator 18 desires to coil a fire hose 200 with the hose flattened and drained. The typical hose will have a body 202, a first end 204, a first end coupling 206, a second end 208 and a second end coupling 210, as shown in FIGS. 8-12. The operator moves the vehicle 12 to a position in substantial alignment with the hose, which is typically laid on the ground 14 in a substantially straight orientation. The hose roller 10 components are easily transported in the bed of a vehicle 12 such as a pickup, and the operator will typically assemble the hose roller at the hose location. The frame 20 is first attached to the vehicle 12 by inserting the frame coupling member 22 into the conventional trailer coupling receiver 24 and securing the attachment. The sub-frame riser 42 is then pinned to the sub-frame 40 using pin 45. The sub-frame and riser are then attached to the frame using sub-frame connection members 38*a,b* and pins 39,49. The roller 110 is then positioned on the roller supports 32*a,b* by inserting the roller spindles 112*a,b* into the roller support grooves 34*a,b*, whereby the roller is free to roll within the supports. The gate 100 is then attached, in the pivotable configuration, by threading gate second end 104 on to the vertical gate member 36*b*.

At this point the operator 18 attaches the spindle rotation assembly 60 by securing the hinge pin 63 through the hinge member 62 and the sub-frame second side member 48, leaving the assembly free to pivot for the moment. If separately transported the controller 84 is then electrically connected to the electric motor 82 using cables 83*a,b* and to the power source using the leads 83*c,d*.

With the hinge member 62 pivoted a small amount toward the rear of the vehicle 12, the operator 18 inserts the first spindle second end 74 through the guide 80 and into the motor 82 for the gear teeth 76 to internally mesh with the motor. Once the second end is inserted the hinge member 62 is pivoted back to a position such that the extension member 66 is aligned with the sub-frame second side 48 and locked into such alignment using pin 64, after the first spindle first end 72 has been placed within the first spindle support rounded notch 47.

After determining the approximate width of the subject hose when flattened, the operator 18 places two guide poles 54*a,b* into frame cross member holes 52 suitable for spacing the guide poles in a manner sufficient to allow smooth passage of the flattened hose between the guide poles, without allowing any substantial lateral motion of the hose. When the guide poles are so positioned the operator picks up the hose first end coupling 206, opens the gate 100 sufficiently to place the hose first end between the gate 100 and the roller 110, guides the hose first end coupling over the roller 110 and through the guide poles 54*a,b* to a point underneath and slightly beyond the first spindle 70.

Figure 8:
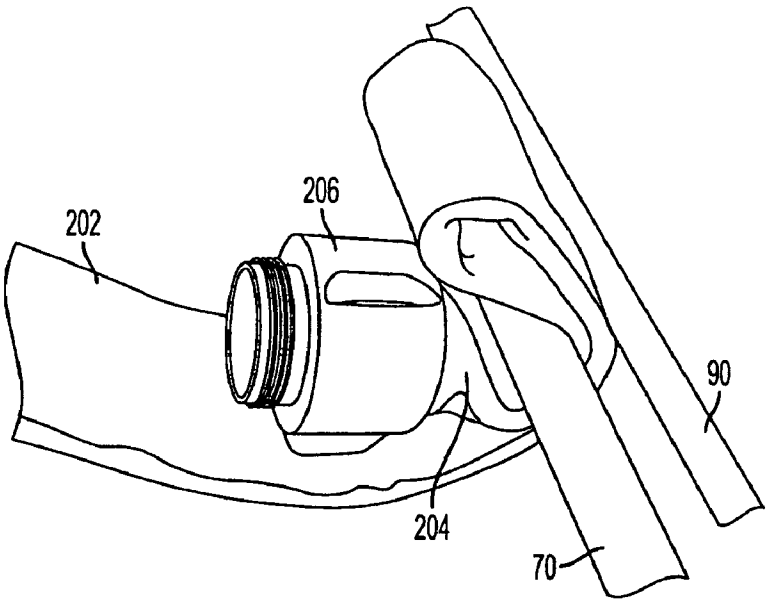
FIG. 8 is a perspective view of a hose coupling and hose being secured between first and second spindle components in an exemplary embodiment of the present invention.
Figure 9:
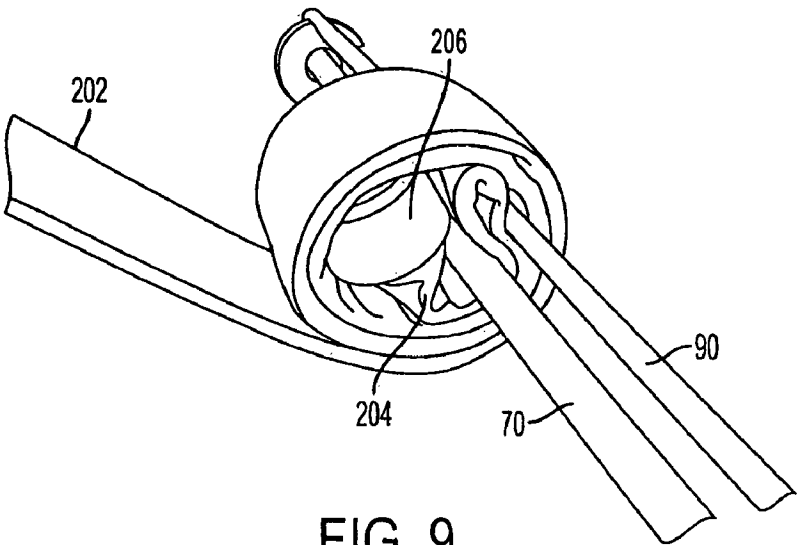
FIG. 9 is a perspective view of the early coiling of a hose about first and second spindle components in an exemplary embodiment of the present invention.
Figure 10:
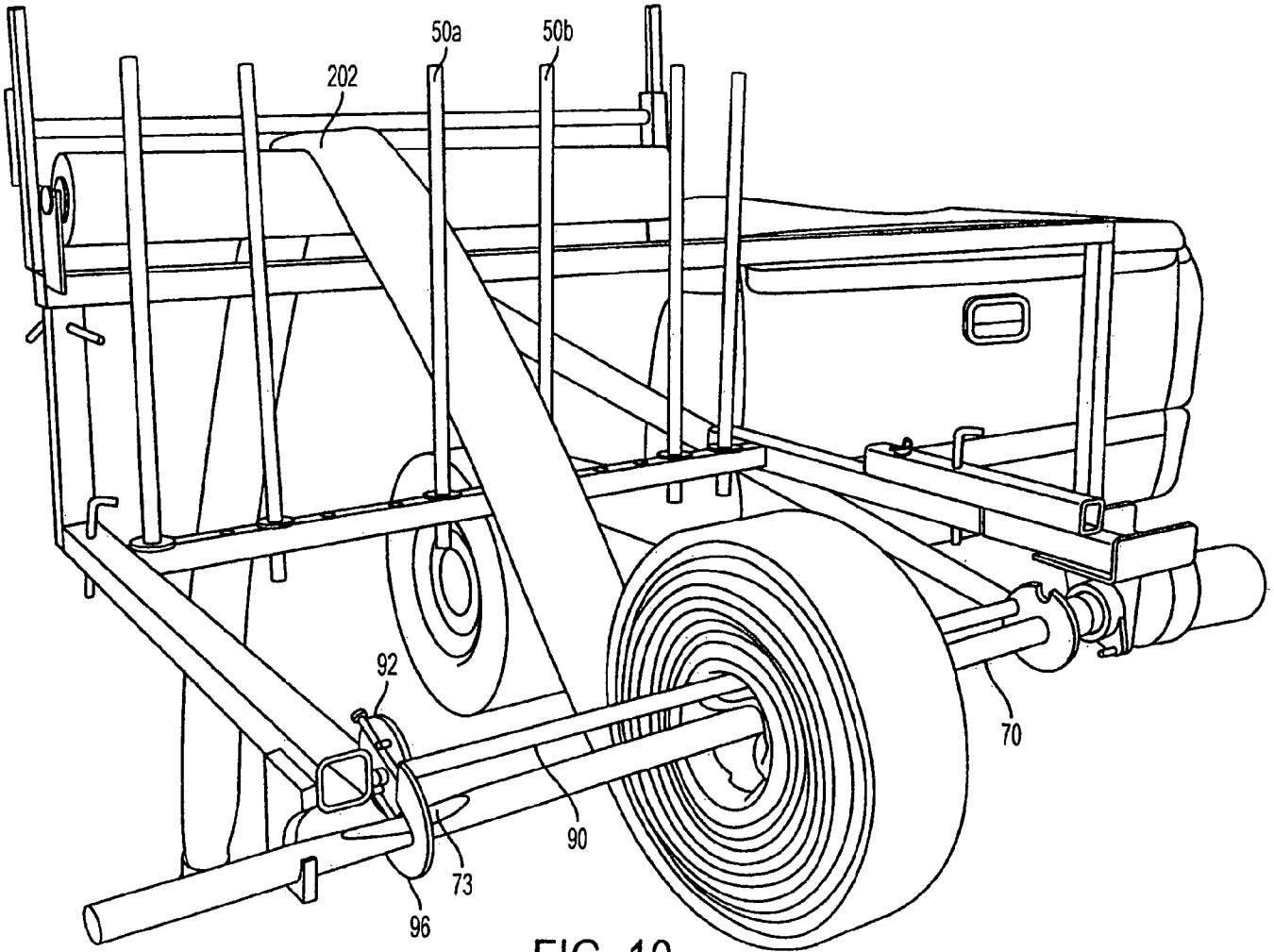
FIG. 10 is a perspective view of an exemplary embodiment of the present invention with a hose being rolled into a coil about first and second spindle components, with the hose being guided by adjustable guides.

As shown in FIG. 8, the operator 18 then folds the hose first end coupling 206 over the hose first end 204, and places the fold about the first spindle 70. While the hose is in this position, the operator places the second spindle second end 92 in the rounded notch 79 on the second spindle support member 78. The lock plate clamp 96 is then placed about the first spindle flattened area 73 and secured to the second spindle lock plate 94 by threading protruding members 97*a,b* through the clamp hooks 98*a,b*, as previously discussed with respect to FIG. 4. Once the lock plate clamp 96 is so secured the first spindle 70 and second spindle 90 trap the fold of the hose, as shown particularly in FIG. 8.

Once the hose first end 204 is secured between the first spindle 70 and second spindle 90, as shown in FIG. 8, the operator 18 then uses the controller 84 to start the motor and rotate the first spindle in a counter-clockwise direction (when viewed from the orientation shown in FIG. 8). The hose body 202 then begins to coil as it is repeatedly wrapped about the first spindle 70 and second spindle 90, as illustrated progressively in FIG. 8, FIG. 9 and FIG. 10. The combined effect of gravity and the flat roller surface cause liquids and air in the hose to drain prior to the hose traveling over the roller.

Figure 11:
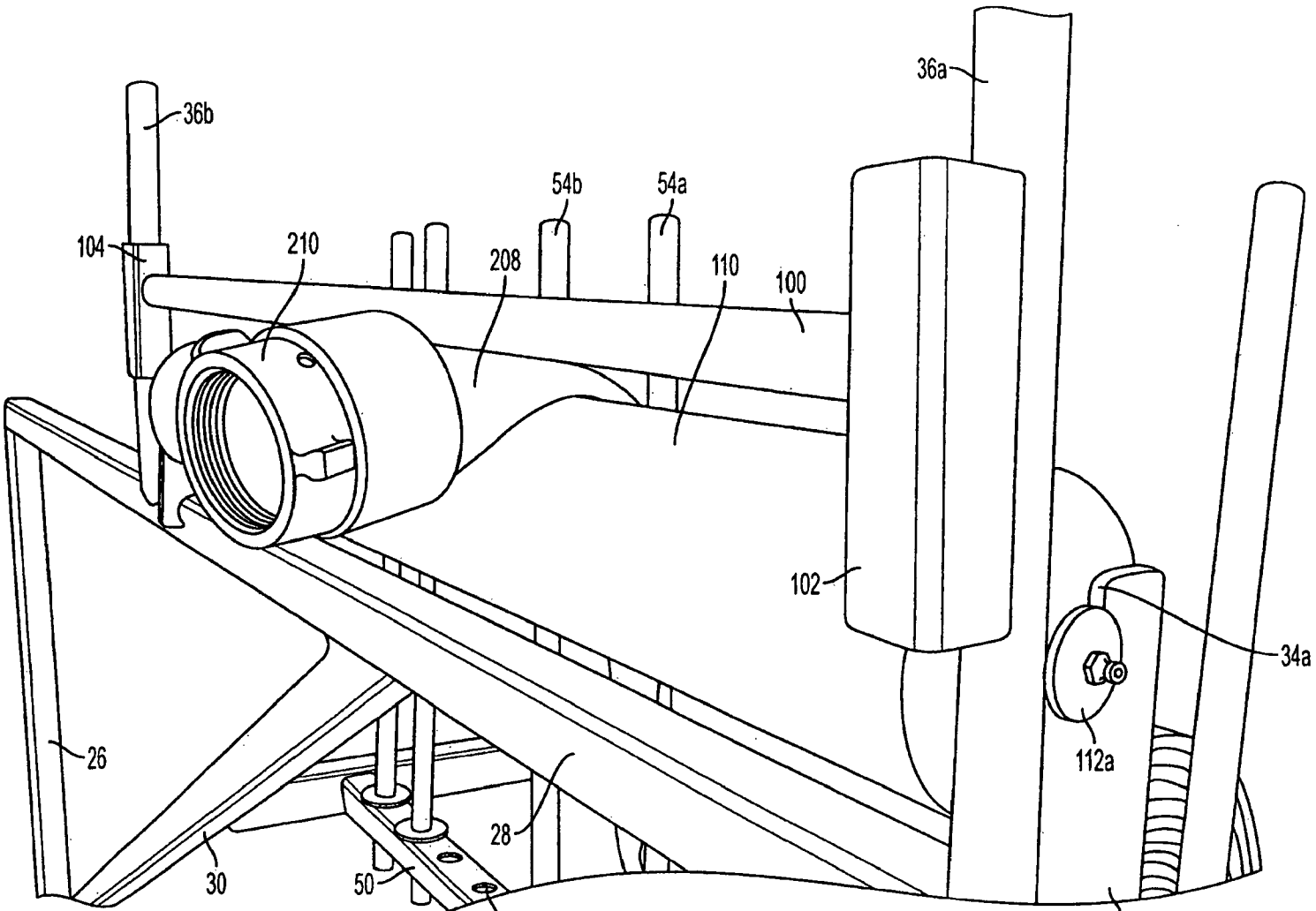
FIG. 11 is a perspective view of a portion of an exemplary embodiment of the present invention with a hose coupling being prevented from inadvertent winding on to the hose coil.
Figure 12:
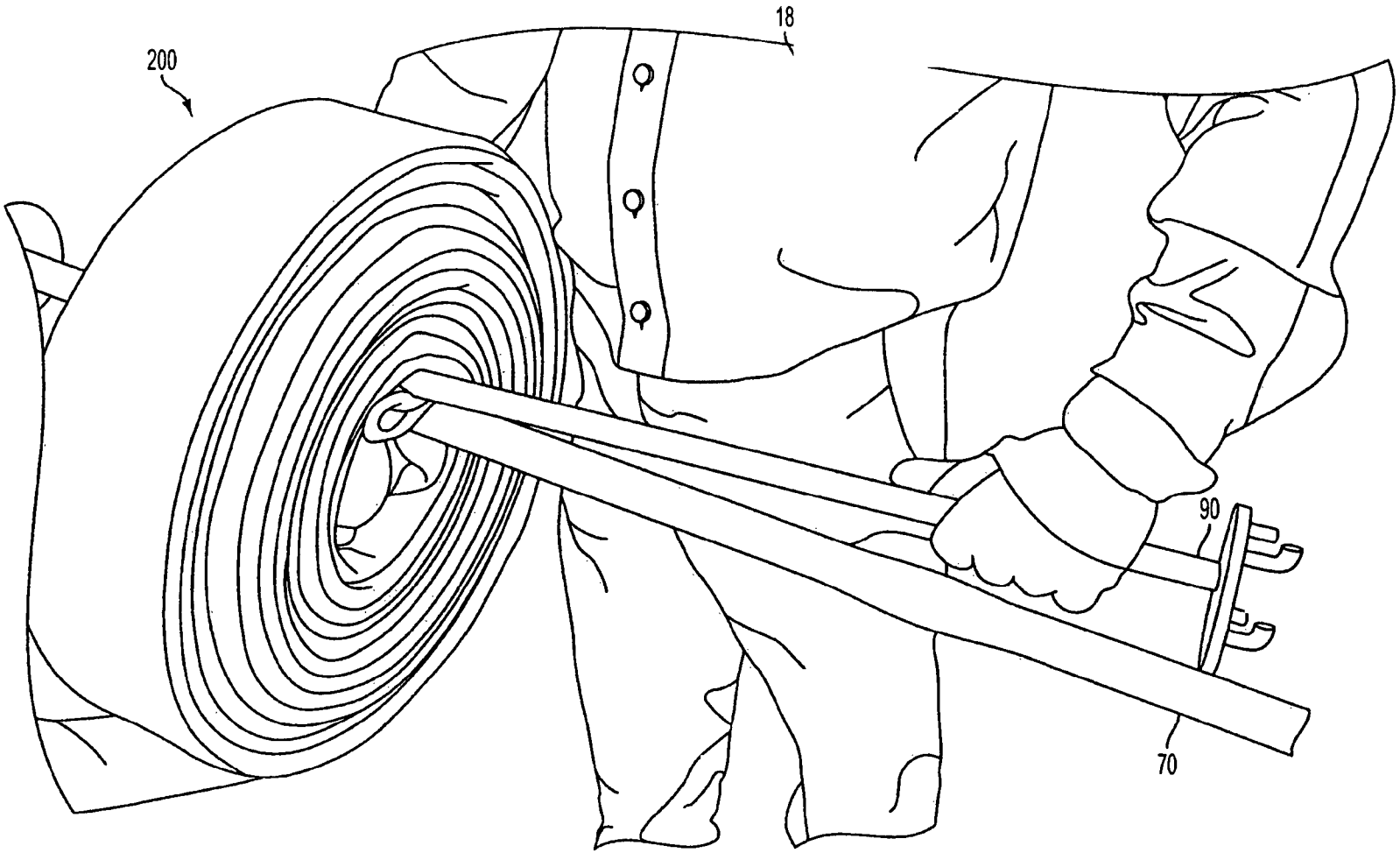
FIG. 12 is a perspective view of an operator removing a second spindle from a hose coil prior to removing the hose coil from the first/primary spindle.

Following a period of such rotation, the hose second end 208 will be drawn close to the gate 100 and roller 110. The operator 18 carefully observes the hose second end coupling 210, as it approaches the gate 100. As illustrated in FIG. 11, the motor is turned off when the hose second end coupling 210 encounters the gate 100 and is thereby prevented from being drawn over the roller 110. After opening the gate 100 to release the hose second end coupling 210, the remaining few feet of drained and flattened hose can quickly be wrapped about the coil and the completed coil moved to another location for storage. The operator then removes the first spindle first end 72 from the first spindle support 46, pulls the pin 64 to release the hinged spindle rotation assembly 60, and pivots the assembly rearwardly to a position similar to that depicted in FIG. 12. Once the operator has removed the lock plate clamp 96, the operator is able to grasp the second spindle 90, pull it from the coiled hose 200, and lay the second spindle aside. At this point, the coiled hose has an unobstructed path along, and off the end of, the first spindle 70 and the first spindle first end 72. The process can be repeated for other hoses, and when all are properly flattened, drained and coiled, the hose roller 10 is ready for disassembly by reversing the assembly steps described above.

In some exemplary embodiments of the present invention, and as illustrated in FIG. 13, the hose roller 10 is capable of rolling a number of different sized hoses 300,400 simultaneously. Having at least one more guide pole, usually two more guide poles 54*c,d*, allows additional hoses to be guided over the roller 110 and to separate securements between the first spindle 70 and second spindle 90.

Figure 14:
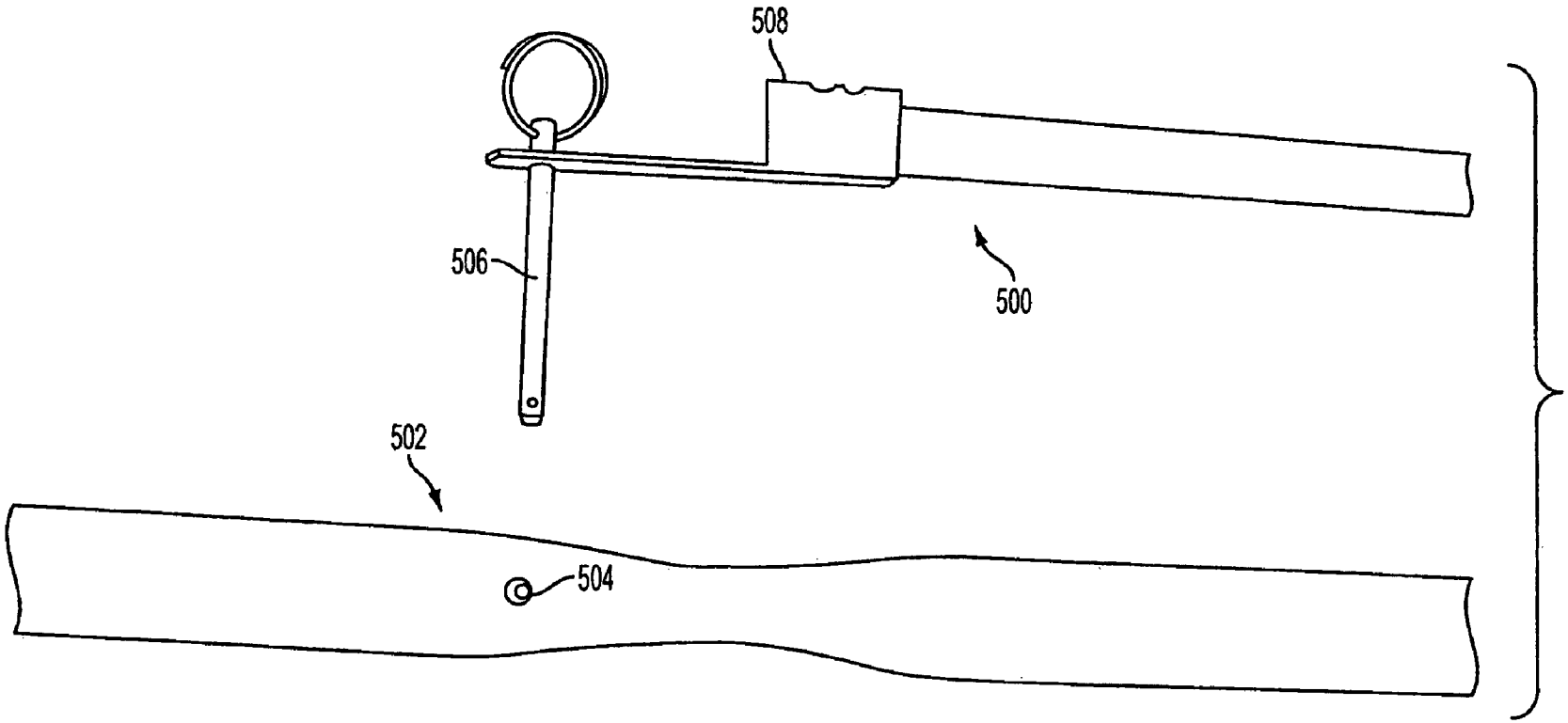
FIG. 14 is a top view of portions of alternate first and second spindles and the manner in which the second is secured to the first.
Figure 15:
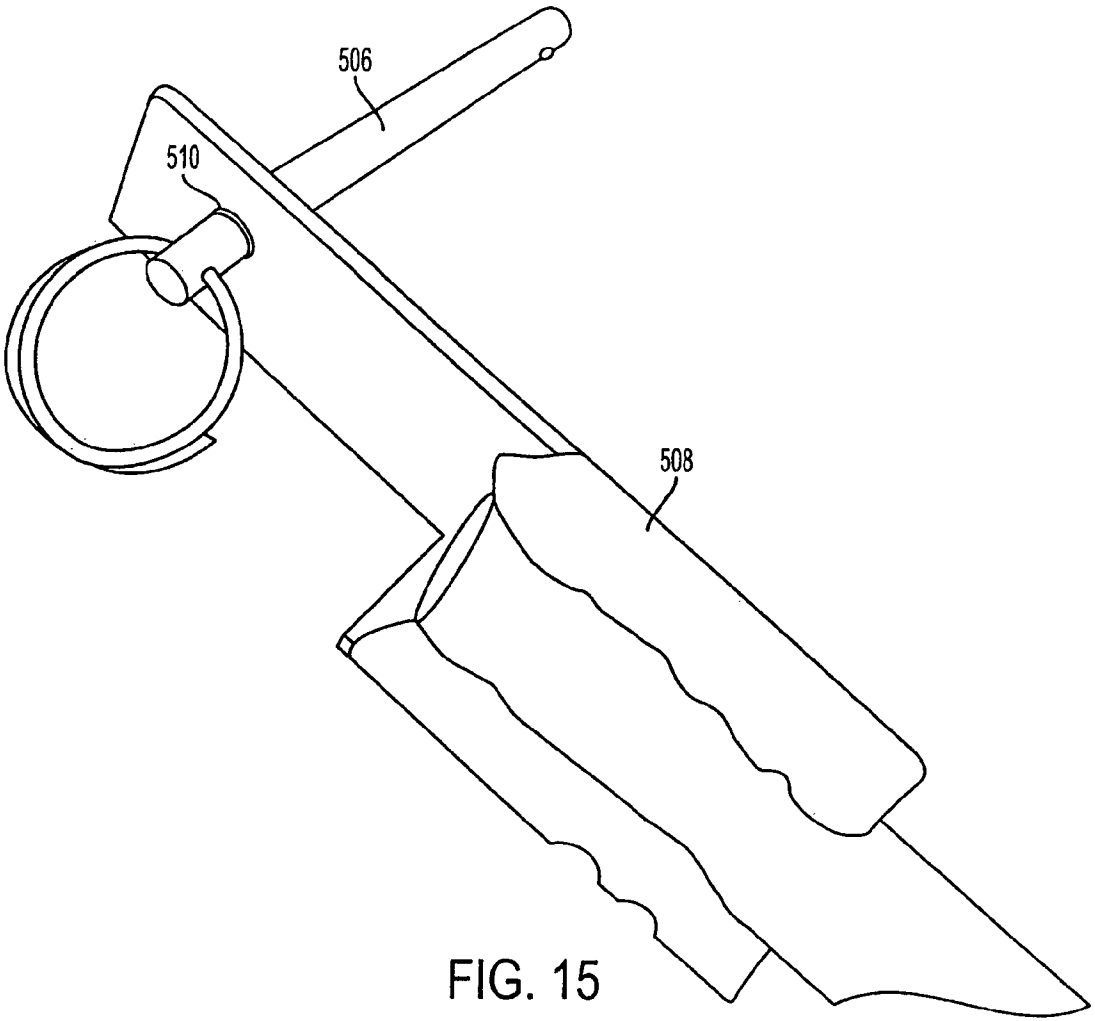
FIG. 15 is a side view of a portion of a second spindle and the pin used in securing the second spindle to the first spindle.

In some exemplary embodiments of the present invention, and as illustrated in FIG. 14 and FIG. 15, the second spindle 500 is attached to the first spindle 502 without the previously described lock plate and lock plate clamp. The first spindle is penetrated by a hole 504 which receives a pin 506 which is attached to the second spindle first end 508 through a hole 510.

In some exemplary embodiments, the rotation of the first spindle is provided by a hand crank instead of an electric motor, the hand crank being readily attachable to a first spindle second end near the present electric motor location.

Exemplary embodiments of the type illustrated in FIGS. 1-15 may be constructed from various materials known to have sufficient strength to handle the weight of the hoses and sufficient stiffness to maintain the desired configuration and the position with respect to the vehicle. In some exemplary embodiments the frame 20 is constructed from ¼"×2" square steel tubing, the sub-frame 40, sub-frame riser 42, gate ends 102*a,b*, hinge member 62, and extension member 64 are constructed from 3/16"×2" square steel tubing, the gate ends 102*a,b* are constructed from 3/16"×1½" square steel tubing, the guidepoles 54*a-d* are constructed from ⅝" Schedule 40 steel piping, the vertical gate members 36*a,b* are constructed from ¾" Schedule 40 steel piping, the gate 100 is constructed from ¾" Schedule 80 steel piping, the gate 100 first spindle 70 is constructed from ¾" Schedule 80 piping, the second spindle 90 is constructed from ¾" solid steel rod, the roller 110 is constructed from a steel cylinder (Schedule 40), the roller supports 32*a,b* are constructed from ¼" steel plate, the tray 86 is constructed from 3/16"×2" angle iron, the second spindle support member 78, second spindle lock plate 94 and lock plate clamp 96 are constructed from ¼" steel plate, the guide pole stops 58 are constructed using 2¼" flat steel washers, and the various pins are constructed from ½"×5½" steel bolts. Prospectively, various plastics may be substitutable for the above components. The electric motor is a 1.5 horsepower conventional electric motor and the guide 80 includes a 1 inch bushing bearing.

It will be understood from the foregoing description that various modifications and changes may be made, and in fact will be made, in the exemplary embodiments of the present invention without departing from its true spirit. The descriptions in this specification are for purposes of illustration only and are not to be construed in a limiting sense.

I claim:

1. An apparatus for rolling a flattenable hose of the type having a first coupling at a hose first end and a second coupling at a hose second end, and a hose portion between the hose first coupling and the hose second coupling, the hose being in the proximity of a vehicle, comprising:

a frame, attachable to the vehicle, the frame having a hinge;

a rotation member, the rotation member being alternately startable and stoppable;

a roller on the frame;

a first spindle on the frame, laterally spaced from the roller, the first spindle having a first end and a second end, the first spindle first end cooperating with the rotation member, such that the first spindle is rotated by the rotation member, the first spindle second end being engaged by the frame for support during rotation;

a second spindle, attachable to the first spindle;

a plurality of guide poles on the frame; and a gate member on the frame, the gate being positionable to a position proximate the roller;

wherein:

the hose first end is placed over the roller, under the gate, and between two of the plurality of guide poles, and the hose drains any liquid contents as the hose first end is elevated over the roller;

the hose first coupling and hose first end are secured to the first spindle by attaching the second spindle to the first spindle;

the first spindle is rotated by starting the rotation member, the hose being rolled about the first and second spindle into a hose coil as the first spindle is rotated, the hose being flattened as the hose is drawn over the roller, the hose being guided by the guide poles, the hose second coupling encountering the gate member as it approaches the roller, the hose second coupling being prevented by the closed gate member from being moved over the roller; and after the rotation member is stopped, the frame is moved on the frame hinge such that the first spindle second end is clear of the frame, the second spindle being detachable from the first spindle and removable from the hose coil, the hose second coupling being removable from the gate member, and the hose coil being removable from the first spindle.

2. The apparatus of claim 1, wherein the gate member is movable from a first position, allowing insertion of the hose first end and hose first coupling to a second position, laterally spaced from the roller, whereby the hose second coupling is prevented from passing the gate member.

3. The apparatus of claim 1, wherein the number of guide poles is at least three such that two hoses are positionable between two guide poles and separated by the guide poles.

4. "The apparatus of claim 1, wherein the rotation member is an electric motor.

5. A method for rolling a flattenable hose of the type having a first coupling at a hose first end and a second coupling at a hose second end, and a hose portion between the hose first coupling and the hose second coupling, the hose being in the proximity of a vehicle, comprising:

attaching a frame to the vehicle, the frame having a hinge and a rotation member, the rotation member being alternately startable and stoppable;

placing a roller on the frame;

placing a first spindle on the frame, the first spindle having a first end and a second end, the first spindle first end cooperating with the rotation member, such that the first spindle is rotated by the rotation member, the first spindle second end being engaged by the frame for support during rotation;

placing a plurality of guide poles on the frame;

attaching a gate to the frame, the gate being swingable to a position proximate the roller;

placing the hose first end over the roller, under the gate, and between two of the plurality of guide poles, the hose draining any liquid contents as the hose first end is elevated over the roller, the hose being flattened against the roller as the roller rotates;

securing the hose first coupling and hose first end by attaching a second spindle to the first spindle;

rotating the first spindle by starting the rotation member, the hose being rolled about the first and second spindle into a hose coil as the first spindle is rotated, the hose being flattened as the hose is drawn over the roller, the hose being guided by the guide poles, the hose second coupling encountering the gate as it approaches the roller, the continued movement of the hose second coupling causing the gate to move to close against the frame, the hose second coupling being prevented by the closed gate from being moved over the roller;

stopping the rotation of the first spindle by stopping the rotation member;

opening the gate and releasing the hose second coupling;

moving the frame on the frame hinge, such that the first spindle second end is clear of the frame;

removing the second spindle from attachment to the first spindle and pulling the second spindle from the hose coil;

pulling the hose coil from the first spindle;

removing the roller, gate, first spindle, and guide poles from the frame; and removing the frame from the vehicle.

6. The method of claim 5, wherein a second hose has a hose first end, a hose first coupling, a hose second end, a hose second coupling, and a hose portion between the hose first coupling and the hose second coupling, the method further comprising:

the step of placing the second hose first end over the roller, under the gate, and between two of the plurality of guide poles, at least one of the two of the plurality being in addition to the two of the plurality of guide poles guiding the first hose, the second hose draining any liquid contents as the second hose first end is elevated over the roller;

and further wherein:

the step of securing the hose first coupling and hose first end, further comprises securing the second hose first coupling and second hose first end, both securements being accomplished by attaching the second spindle to the first spindle;

the step of rotating the first spindle by starting the rotation member further results in the second hose being rolled about the first and second spindle into a second hose coil as the first spindle is rotated, the second hose being flattened as the second hose is drawn over the roller, the second hose being guided by the guide poles;

the step of removing the second spindle from attachment to the first spindle and pulling the second spindle from the hose coil further comprises pulling the second spindle from the second hose coil;

the step of pulling the hose coil from the first spindle, further comprises pulling the second hose coil from the first spindle.

7. The method of claim 5, wherein the frame positions the first spindle in a substantially perpendicular orientation to the vehicle's longitudinal axis, and the method further comprises the step of moving the vehicle in a substantially parallel path to the hose, as the hose is being rolled.

* * * * *